US011965407B2

(12) United States Patent
Alali et al.

(10) Patent No.: US 11,965,407 B2
(45) Date of Patent: Apr. 23, 2024

(54) METHODS AND SYSTEMS FOR WELLBORE PATH PLANNING

(71) Applicant: SAUDI ARABIAN OIL COMPANY, Dhahran (SA)

(72) Inventors: Ammar Alali, Dhahran (SA); Mahmoud Abughaban, Dhahran (SA); Victor Carlos Costa De Oliveira, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 217 days.

(21) Appl. No.: 17/457,773

(22) Filed: Dec. 6, 2021

(65) Prior Publication Data

US 2023/0175379 A1 Jun. 8, 2023

(51) Int. Cl.
*E21B 44/00* (2006.01)

(52) U.S. Cl.
CPC ..... *E21B 44/00* (2013.01); *E21B 2200/20* (2020.05); *E21B 2200/22* (2020.05)

(58) Field of Classification Search
CPC .. E21B 44/00; E21B 2200/20; E21B 2200/00; E21B 2200/22; E21B 7/04; E21B 7/00
See application file for complete search history.

(56) References Cited

U.S. PATENT DOCUMENTS 6,424,919 B1 7/2002 Moran et al.
6,732,052 B2 5/2004 Macdonald et al.
8,527,248 B2 9/2013 Thambynayagam et al.
9,291,735 B2 3/2016 Lu et al.
10,203,427 B2 2/2019 Thompson et al.
10,968,730 B2 4/2021 Wang et al.
10,989,038 B1 4/2021 Shen et al.
11,339,640 B2 5/2022 Alali et al.
(Continued)

FOREIGN PATENT DOCUMENTS

CN 104806226 B 8/2018
WO 2005001661 A2 1/2005
WO 2021150929 A1 7/2021

OTHER PUBLICATIONS

Aridas et al., "Uncertainty based under-sampling for learning Naive Bayes classifiers under imbalanced data sets", IEEE Access, 2016, vol. 4, pp. 1-12 (Year: 2016).*
(Continued)

*Primary Examiner* — Mohamed Charioui
(74) *Attorney, Agent, or Firm* — Osha Bergman Watanabe & Burton LLP

(57) ABSTRACT

Methods and systems for wellbore path planning are disclosed. The method includes defining total depth coordinates of a candidate wellbore path within a hydrocarbon reservoir, obtaining geoscience data for a subterranean region enclosing the hydrocarbon reservoir, and obtaining historical drilling data from an offset well in the subterranean region. The method further includes training a machine learning network to predict drilling hazard probabilities along the candidate wellbore path using the geoscience data and the historical drilling data. The method still further includes determining a first wellbore path to terminate at the total depth coordinates using the candidate wellbore path and the trained machine learning network.

17 Claims, 6 Drawing Sheets

(56) References Cited

U.S. PATENT DOCUMENTS

| | | | | |
|---|---|---|---|---|
| 2009/0132458 | A1 | 5/2009 | Edwards et al. | |
| 2015/0247396 | A1 | 9/2015 | Tunc et al. | |
| 2015/0300151 | A1 | 10/2015 | Mohaghegh | |
| 2018/0202266 | A1 | 7/2018 | Holland et al. | |
| 2020/0157887 | A1* | 5/2020 | Alonso | E21B 43/30 |
| 2020/0183032 | A1 | 6/2020 | Liu et al. | |
| 2020/0277848 | A1 | 9/2020 | Johnston et al. | |
| 2021/0285316 | A1* | 9/2021 | Venkatakrishnan | G06N 7/01 |
| 2021/0397994 | A1* | 12/2021 | Cerrahoglu | E21B 47/00 |
| 2021/0404313 | A1* | 12/2021 | Saidutta | E21B 41/00 |

OTHER PUBLICATIONS

A. K. Abbas et al. "Wellbore Trajectory Optimization Using Rate of Penetration and Wellbore Stability Analysis" Society of Petroleum Engineers; Dec. 10, 2018 (11 pages).

M. F. Abughaban et al. "Advanced Trajectory Computational Model Improves Calculated Borehole Positioning, Tortuosity and Rugosity" SPE-178796-MS; Presented at the IADC/SPE Drilling Conference and Exhibition, Fort Worth, Texas; Mar. 1-3, 2016 (26 pages).

M. F. Abughaban et al. "Improving Torque and Drag Prediction Using the Advanced Spline Curves Borehole Trajectory" SPE-184611-MS; Presented at the SPE/IADC Drilling Conference and Exhibition, the Hague, the Netherlands; Mar. 14-16, 2017 (29 pages).

Gao Deli "Predicting and Scanning of Wellbore Trajectory in Horizontal Well Using Advanced Models" SPE 29982; Society of Petroleum Engineers; Beijing, China; Nov. 14-17, 1995 (12 pages).

Himmerlberg, N., & Eckert, A. "Wellbore Trajectory Planning for Complex Stress States" American Rock Mechanics Association (ARMA); Jan. 1, 2013 (10 pages).

G.H.F. Gardner et al. "Formation velocity and density—the diagnostic basics for stratigraphic traps" Geophysics, vol. 39, No. 6; Dec. 1974 (11 pages).

A. Elhakam et al. "Reliability of using nondestructive tests to estimate compressive strength of building stones and bricks" Alexandria Engineering Journal, 51; 2012 (11 pages).

K. B. Chary et al. "Evaluation of Engineering Properties of Rock Using Ultrasonic Pulse Velocity and Uniaxial Compressive Strength" National Seminar on Non-Destructive Evaluation, 2006 (7 pages).

M. R. J. Wyllie et al. "Elastic Wave Velocities in Heterogeneous and Porous Media" Geophysics 21 (1); 1956 (30 pages).

M. Bahorich et al. "3-D seismic discontinuity for faults and stratigraphic features: The coherence cube" The Leading Edge, 14, No. 10, 1995 (6 pages).

G. Jones et al. "Seismic attributes maps; application to structural interpretation and fault seal analysis in the North Sea basin" First Break, vol. 14, No. 12; Dec. 1996 (13 pages).

J. B. Bednar "Least squares dip and coherency attributes" The Leading Edge, 17, Houston, Texas; 1998 (2 pages).

J. Hesthammer "Evaluation of the timedip, correlation and coherence maps for structural interpretation of seismic data" First Break, 16; May 5, 1998 (17 pages).

P. An et al. "Reservoir characterization using seismic waveform and feedforword neural networks" Geophysics, vol. 66, No. 5; Sep.-Oct. 2001 (8 pages).

Y. Ben et al. "Development and Application of a Real-Time Drilling State Classification Algorithm with Machine Learning" Unconventional Resources Technology Conference (URTeC); Denver Colorado; Jul. 22-24, 2019 (14 pages).

N. Dolle et al. "Game-Changing AI for Faster and Better Well Trajectory Planning Decisions (An Example Using the Volve Dataset)" 82nd EAGE Conference & Exhibition 2020; Amsterdam, the Netherlands; Dec. 8-11, 2020 (5 pages).

J. A. Cartwright "Polygonal Fault Systems: A New Type of Fault Structure Revealed by 3-D Seismic Data from the North Sea Basin" AAPG Studies in Geology No. 42 and SEG Geophysical Developments Series No. 5, AAPG/SEG Jan. 1, 1996 (13 pages).

Bharti Chawre "Correlations between ultrasonic pulse wave velocities and rock properties of quartz-mica schist" Journal of Rock Mechanics and Geotechnical Engineering; 2018 (10 pages).

* cited by examiner

METHODS AND SYSTEMS FOR WELLBORE PATH PLANNING

BACKGROUND

In the oil and gas industry, time and cost are associated with drilling a wellbore path to access a hydrocarbon reservoir. As such, it may be advantageous to plan a wellbore path prior to drilling. Available data, such as geoscience data, may be used to better understand the subterranean region where the wellbore path will ultimately be drilled. Further, available data may be used to avoid hazards while drilling the planned wellbore path. Machine learning networks may be powerful predictive tools that can be used, at least in part, to aid in planning a wellbore path using the available data.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a method. The method includes defining total depth coordinates of a candidate wellbore path within a hydrocarbon reservoir, obtaining geoscience data for a subterranean region enclosing the hydrocarbon reservoir, and obtaining historical drilling data from an offset well in the subterranean region. The method further includes training a machine learning network to predict drilling hazard probabilities along the candidate wellbore path using the geoscience data and the historical drilling data. The method still further includes determining a first wellbore path to terminate at the total depth coordinates using the candidate wellbore path and the trained machine learning network.

In general, in one aspect, embodiments relate to a non-transitory computer readable medium storing instructions executable by a computer processor. The instructions include functionality for receiving total depth coordinates of a candidate wellbore path within a hydrocarbon reservoir, receiving geoscience data for a subterranean region enclosing the hydrocarbon reservoir, and receiving historical drilling data from an offset well in the subterranean region. The instructions further include training a machine learning network to predict drilling hazard probabilities along the candidate wellbore path using the geoscience data and the historical drilling data. The instructions still further include determining a first wellbore path to terminate at the total depth coordinates using the candidate wellbore path and the trained machine learning network.

In general, in one aspect, embodiments relate to a system including a computer system configured to receive total depth coordinates of a candidate wellbore path within a hydrocarbon reservoir, receive geoscience data for a subterranean region enclosing the hydrocarbon reservoir, and receive historical drilling data from an offset well in the subterranean region. The computer system is further configured to train a machine learning network to predict drilling hazard probabilities along the candidate wellbore path using the geoscience data and the historical drilling data. The computer system is still further configured to determine a first wellbore path to terminate at the total depth coordinates using the candidate wellbore path and the trained machine learning network. In general, in another aspect, embodiments relate to a system including a drilling system configured to drill the first wellbore path.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
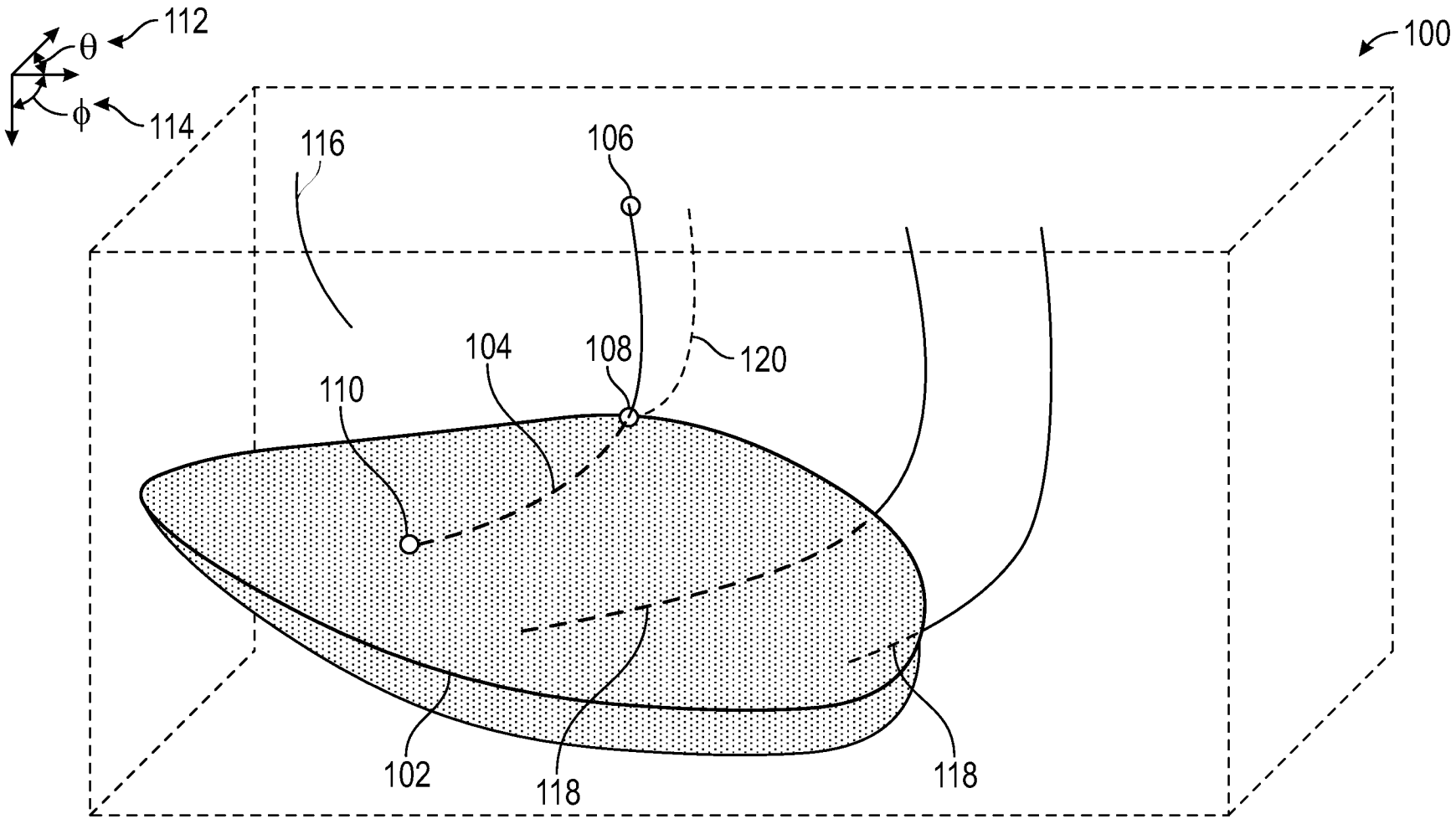
FIG. 1 depicts a subterranean region in accordance with one or more embodiments.

FIG. 1 depicts a subterranean region (100) that may contain a hydrocarbon reservoir (102). A wellbore path (104) may be planned to access resources within the hydrocarbon reservoir (102) in the future. A wellbore path (104) may be defined by the surface coordinates (hereinafter "well head coordinates") (106), target entry coordinates (108), and total depth coordinates (110) as well as by the inclination angle (112), 0, and azimuthal angle (114), $\varphi$, at measured depths along the wellbore path (104). The well head coordinates (106) may define the initiation point of the wellbore path (104) on the surface of the Earth. The target entry coordinates (108) may define the intersection point between the wellbore path (104) and the hydrocarbon reservoir (102). Further, the total depth coordinates (110) may define the end of the wellbore path (104) that may be within the hydrocarbon reservoir (102).

To minimize the time and cost of drilling a wellbore path (104), it may be advantageous to utilize geoscience data in the subterranean region (100) as well as drilling data from currently drilling offset wells (116) and drilling data from previously drilled offset wells (118) to plan a wellbore path (104) prior to drilling. Geoscience data may include geophysical data, geological data, and geomechanical data. Specifically, geophysical data may include pre-stacked depth migrated seismic data, pre-stacked time migrated seismic data, post-stacked depth migrated seismic data, post-stacked time migrated seismic data, post-stacked time migrated seismic data stretched to depth, a velocity model, and seismic attributes. Geological data may include petrophysical data and facies classification. Lastly, geomechanical data may include pressure data, strain data, and stress data. Geoscience data may provide insight as to the location of geological discontinuities, such as faults, and sedimentary layers as well as to the physical properties of rock such as type, porosity, and thickness within each sedimentary layer. Drilling data from currently drilling offset wells (116) and drilling data from previously drilled offset wells (118) may include a wellbore path, dogleg severities, dynamic drilling parameters, static drilling parameters, and non-productive time incidents for each offset well (116, 118). Hereinafter, drilling data from currently drilling offset wells (116) and drilling data from previously drilled offset wells (118) will be collectively referred to as "historical drilling data". Historical drilling data may provide insight into how the wellbore path (104) could be drilled and the challenges of drilling the wellbore path (104). Further, knowing the wellbore path of the offset wells (116, 118) may ensure the wellbore path (104) does not collide with the offset wells (116, 118). Analysis of the geoscience data and historical drilling data may cause the wellbore path (104) to be changed to a revised or first wellbore path (120) prior to and/or during drilling.

Figure 2:
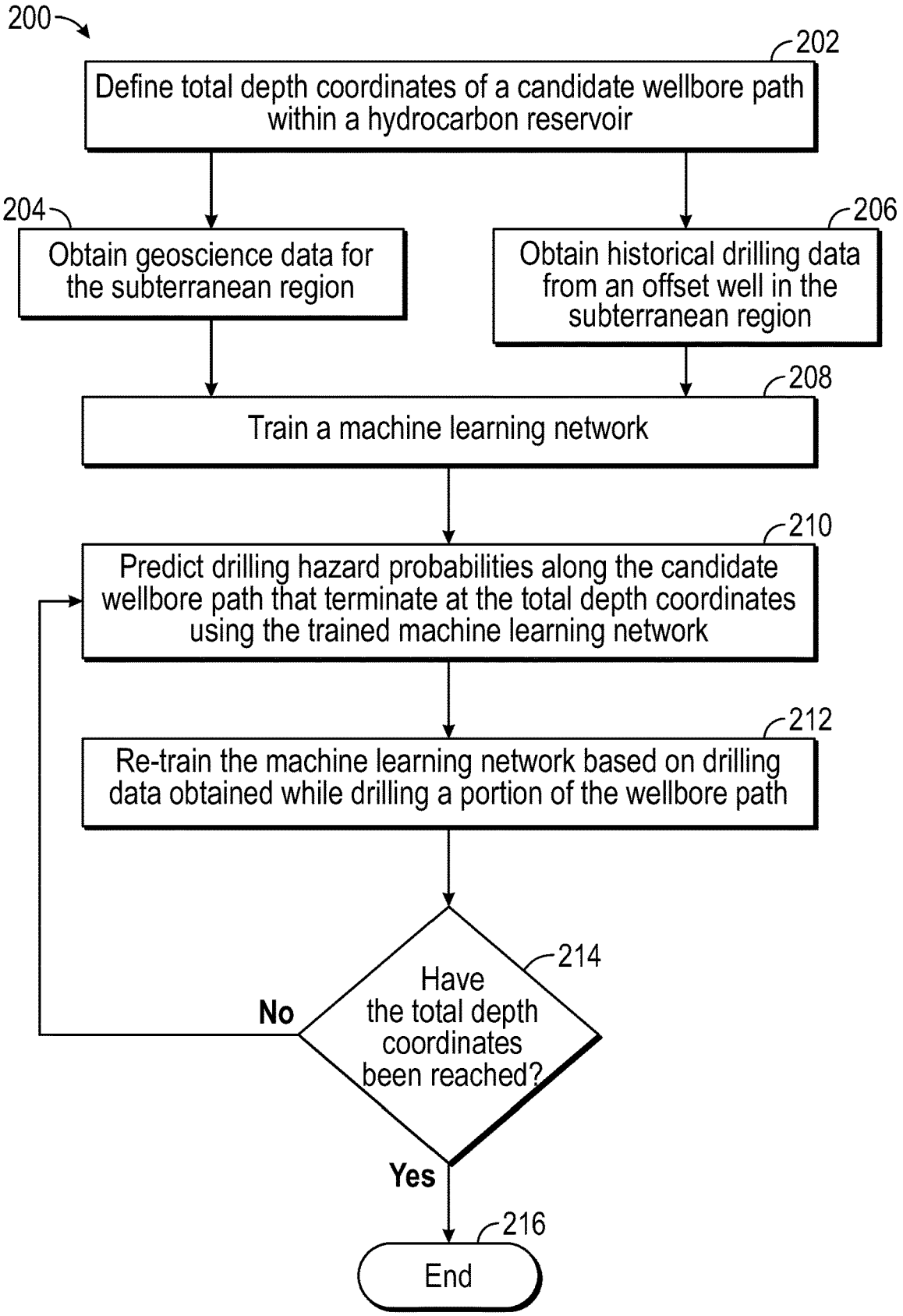
FIG. 2 shows a flowchart in accordance with one or more embodiments.

FIG. 2 describes a method (200) to plan a wellbore path (104) using geoscience data, historical drilling data from offset wells (116, 118), and a machine learning network. The planning may occur prior to the commencement of drilling and may be revised or extended during drilling of the wellbore path (104). In Step 202, total depth coordinates (110) are defined within a hydrocarbon reservoir (102) in a subterranean region (100). The location of the total depth coordinates (110) may be based, at least in part, on the expectation that the wellbore path (104) may access an area of prolific production in the hydrocarbon reservoir (102).

In Steps 204, geoscience data from offset wells (116, 118) may be collected from current and previous wellbores and surveys of the subterranean region (100). In Steps 206, historical drilling data from offset wells (116, 118) may be collected from current and previous wellbores and surveys of the subterranean region (100). The geoscience data and historical drilling data may be conditioned, transformed, and/or normalized. Conditioning may include using signal processing tools to enhance a signal, correct a signal, and/or attenuate noise without distorting the signal of interest. Transforming may include using empirical modeling and/or mechanistic modeling to estimate subterranean region (100) and offset well (116, 118) information not immediately included in the geoscience data or historical drilling data. Further, normalization may include scaling data, typically to between zero and one.

In Step 208, the geoscience data and historical drilling data from offset wells (116, 118) may be used to train the machine learning network. The training data may be separated into two classes: a "non-hazard" class and a "hazard" class. The quantity of training data samples between classes may be skewed. For example, the sample size of the training data of the "non-hazard" class may be larger than the sample size of the training data of the "hazard" class to yield the "non-hazard" class the majority class and the "hazard" class the minority class. Due to the sample size imbalance between classes, imbalanced classification, a supervised learning approach, may be utilized by the machine learning network. Imbalanced classification algorithms may include random undersampling, SMOTE oversampling, cost-sensitive logistic regressions, cost-sensitive decision trees, cost-sensitive support vector machines, and weighted decision trees. Undersampling algorithms may involve the deletion of majority class samples while oversampling algorithms may involve sampling the minority class samples repeatedly. A combination of undersampling algorithms and oversampling algorithms may also be used. Alternatively, cost or weighted algorithms take into account the costs associated with misclassification during training. The machine learning network may further utilize a probabilistic approach to assign probabilities of what class input data may lie in. For example, the machine learning network may predict the likelihood of an input being in the "non-hazard" class versus the "hazard" class (i.e., the input has an 80% chance of being in the "non-hazard" class and a 20% chance of being in the "hazard" class).

In step 210, once the machine learning network is trained, a candidate wellbore path (104) to access the most prolific areas of the hydrocarbon reservoir (102) may be input into the machine learning network. The candidate wellbore path (104) may be defined by the well head coordinates (106), target entry coordinates (108), and total depth coordinates (110) as well as by the inclination angle (112), $\theta$, and azimuthal angle (114), $\varphi$, at measured depths along the candidate wellbore path (104). The machine learning network may output probabilities of drilling hazards, one class in the machine learning network, along the candidate wellbore path (104) within the subterranean region (100). Drilling hazards may include collision with an offset well (116, 118), penetration of shallow gas pockets, penetration of a fault, and other pre-defined collision rules. If drilling hazard probabilities along the candidate wellbore path (104) exceed a pre-defined threshold, a first wellbore path (120) may be suggested to reduce the drilling hazard probabilities. Alternatively, if drilling hazard probabilities do not exceed the pre-defined threshold, the candidate wellbore path may now be assigned as the first wellbore path (120).

In step 212, the first wellbore path (120) may be drilled. During drilling, first drilling data (hereinafter also "drilling data") may be collected and used in real-time, along with the geoscience data and historical drilling data, to re-train the machine learning network. The re-training may include updating the parameters of the machine learning network using the historical drilling data if currently drilling offset wells (116) have been further drilled since the machine learning network was trained. The re-training may further include updating the parameters of the machine learning network using the drilling data acquired while drilling the first wellbore path (120). The drilling hazard probabilities in the not yet drilled portion of the first well path (120) may be re-evaluated using the re-trained machine learning network. The first wellbore path (120) remaining to be drilled may be input into the re-trained machine learning network and a second wellbore path for the remaining portion to be drilled may be suggested. Steps 210 and 212 may be performed repeatedly until the wellbore path being drilled terminates at the total depth coordinates (110) within the hydrocarbon reservoir (102) as shown by block 214. Once the wellbore path being drilled terminates at the total depth coordinates (110), the method (200) ends as shown by block 216.

Figure 3A:
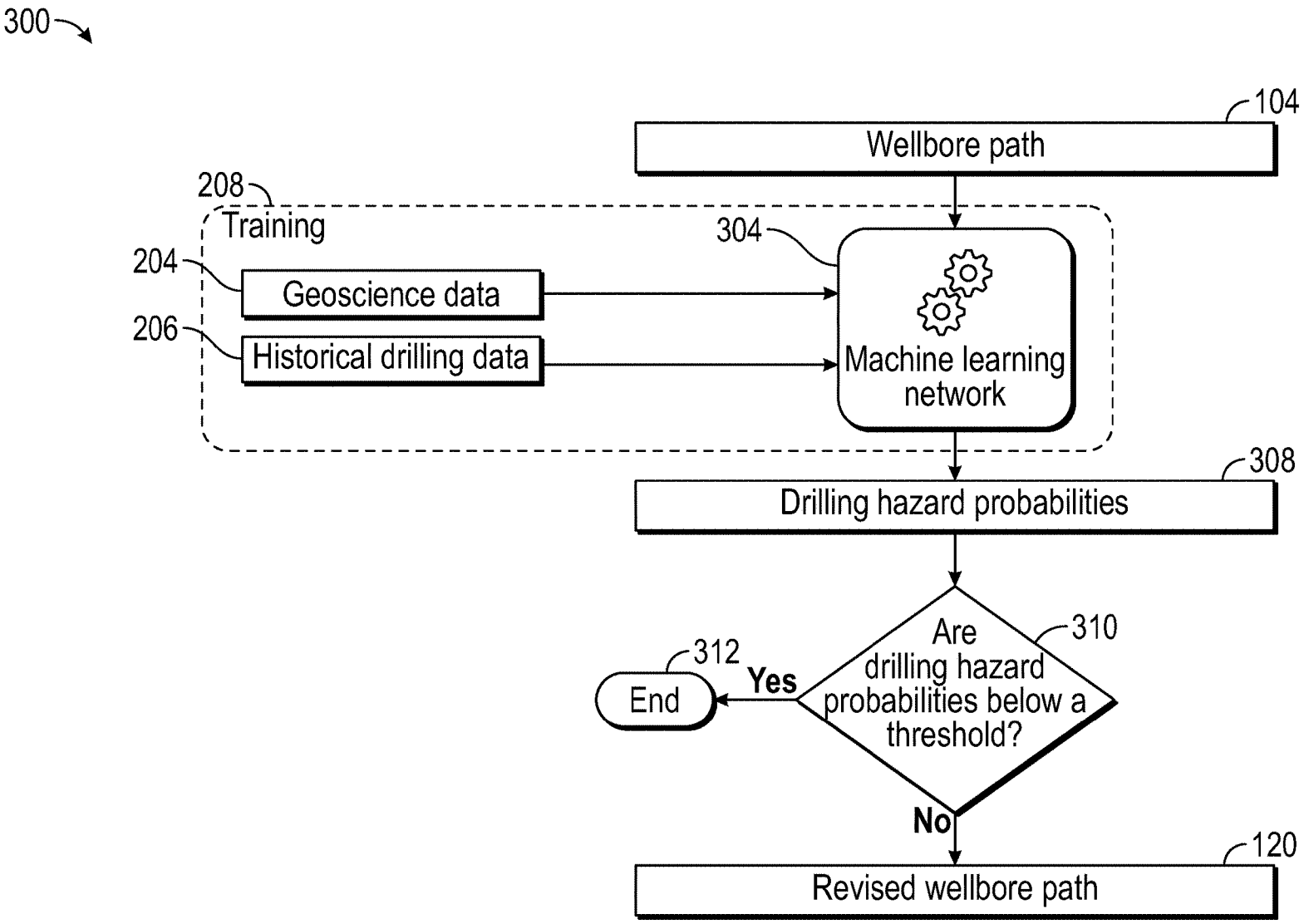
FIG. 3A shows a flowchart in accordance with one or more embodiments.
Figure 3B:
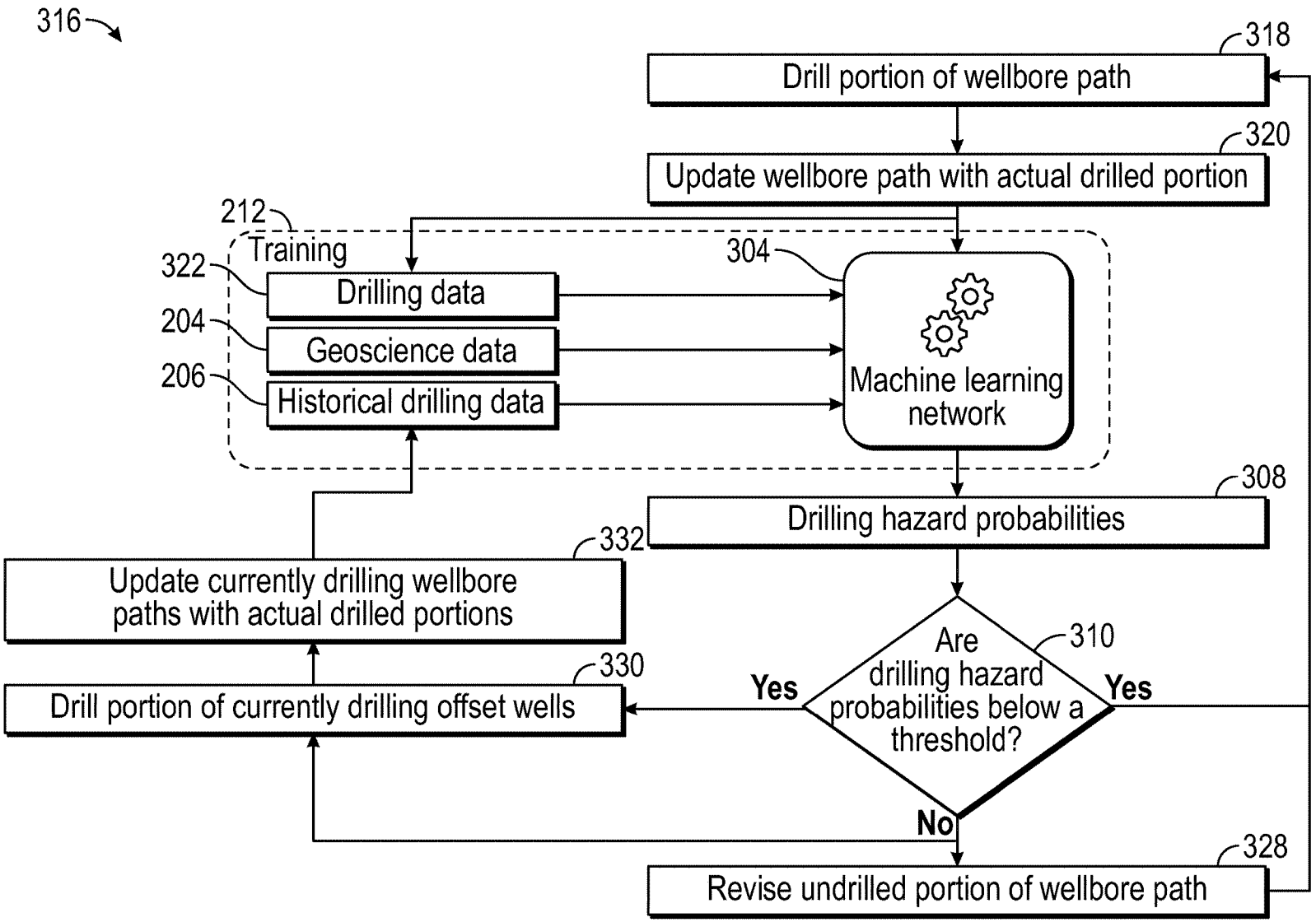
FIG. 3B shows a flowchart in accordance with one or more embodiments.

The method (200) described in FIG. 2 may be considered to have a pre-drilling phase as shown by FIG. 3A (300) and an intra-drilling phase as shown in FIG. 3B (316). During the pre-drilling phase (300), training (208) of the machine learning network (304) may be initially performed using the geoscience data (204) and the historical drilling data (206). Once the machine learning network (304) is trained, a candidate wellbore path (104) may be input into the machine learning network (304) and predicted drilling hazard probabilities (308) along the candidate wellbore path (104) may be output. A drilling hazard probability may be defined as the likelihood that a discrete location along the candidate wellbore path (104) falls into the "hazard" class.

In step 310, a decision may be made to determine if any drilling hazard probabilities (308) along the candidate wellbore path (104) are below a pre-defined threshold. If drilling hazard probabilities (308) along the candidate wellbore path (104) are below a pre-defined threshold, the pre-drilling phase (300) ends (312) and the candidate wellbore path (104) may be drilled. If any drilling hazard probabilities (308) along the candidate wellbore path (104) are above the pre-defined threshold, a revised or first wellbore path (120) may be suggested, either manually or automatically, to reduce drilling hazard probabilities (308). The first wellbore path (120) may then be drilled.

Following the pre-drilling phase (300), the intra-drilling phase (316) begins. First, drilling begins following the first wellbore path (120) determined during the pre-drilling phase (300). The first wellbore path (120) may or may not be the candidate wellbore path (104). Once a portion of the first wellbore path (120) has been drilled (318), the first wellbore path (120) is updated based on the wellbore path that was actually drilled (320). This wellbore path may be the same as the first wellbore path (120) but may be different due to inaccuracies in the drill system. Next, first drilling data (322) acquired during drilling may be used in conjunction with the geoscience data (204) and historical drilling data (206) to re-train (212) the machine learning algorithm (304). Similar to historical drilling data (206), drilling data (322) may include the actual wellbore path, dogleg severities, dynamic drilling parameters, static drilling parameters, and non-productive time incidents. Further, if currently drilling offset wells (116) have been further drilled since the machine learning network was last trained or last re-trained, the historical drilling data used for re-training may be updated as shown by blocks 330 and 332 in FIG. 3B. Once the machine learning network (304) is re-trained (212), the first wellbore path (320) may be input into the machine learning network (304) and predicted drilling hazard probabilities (308) along the first wellbore path (320) may be output.

In step 310, a decision may be made to determine if any drilling hazard probabilities (308) along the first wellbore path (320) are below a pre-defined threshold. If drilling hazard probabilities (308) along the first wellbore path (320) are below a pre-defined threshold, the next portion of the first wellbore path (320) may be drilled (318). If any drilling hazard probabilities (308) along the first wellbore path (320) are above the pre-defined threshold, a second wellbore path may be suggested for the undrilled portion of the wellbore path, either manually or automatically, to reduce drilling hazard probabilities (308). The next portion of the second wellbore path (328) may then be drilled. The intra-drilling phase (316) may continue until the wellbore path reaches the total depth coordinates (110) within the hydrocarbon reservoir (102).

Figure 4:
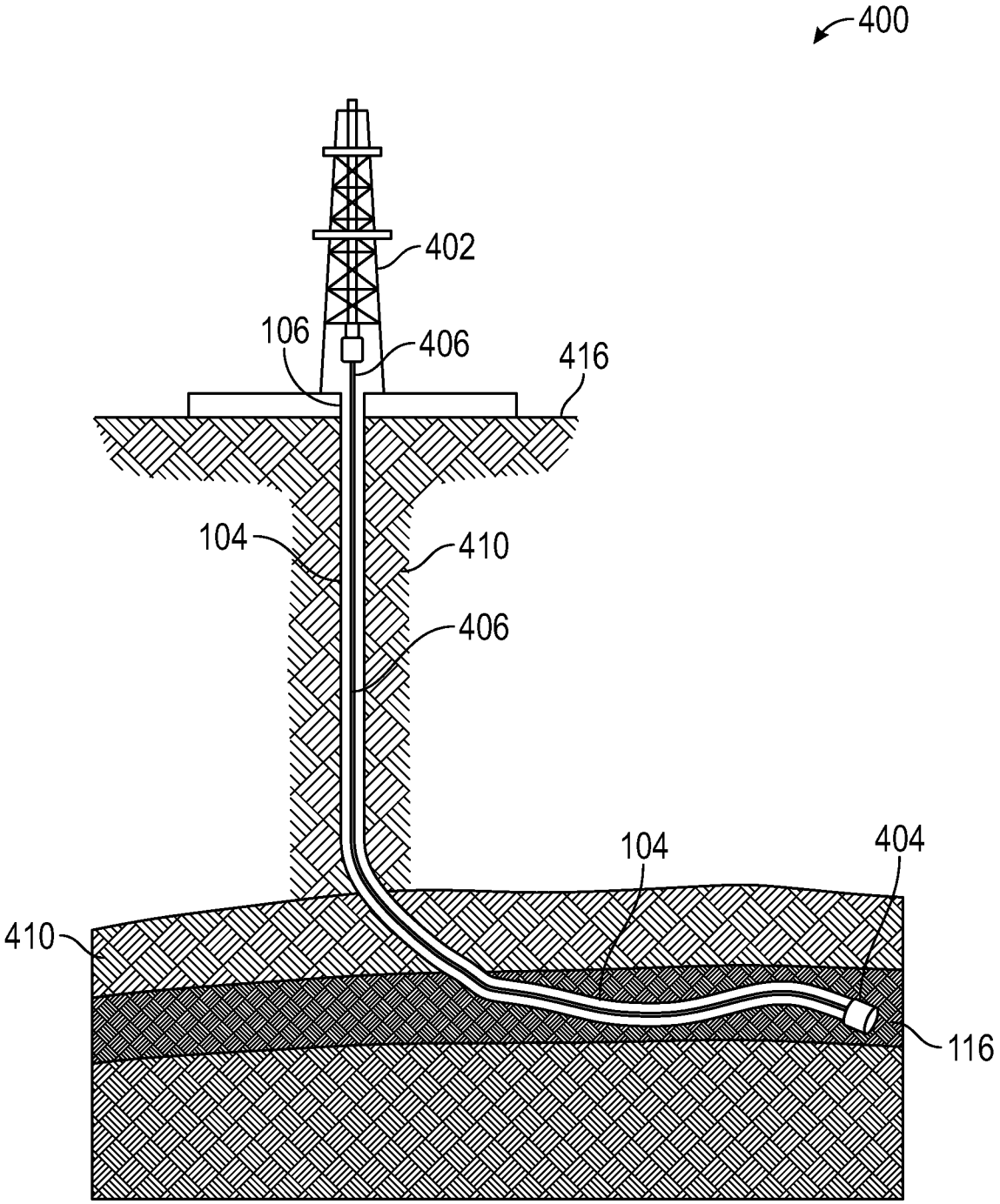
FIG. 4 depicts a drilling system in accordance with one or more embodiments.

FIG. 4 illustrates a drill system (400) configured to drill the wellbore path (104), in accordance with one or more embodiments. The wellbore path (104) may be drilled using a drill bit (404) attached to a drillstring (406), which may include geosteering tools such as a rotary steerable system and a drilling motor. The drillstring (406) may be further attached to a drill rig (402), where the drill rig (402) is located on the Earth's surface (416) at the well head (106). The wellbore path (104) may traverse a plurality of overburden sedimentary layers (410) to terminate at total depth coordinates (110) within a hydrocarbon reservoir (102). The drill system (400) may be a geosteering system such that the wellbore path (104) may be accurately followed coupled with real-time drilling data (322) collection in order to re-train the machine learning network (304) after each portion of the wellbore path is drilled.

Figure 5:
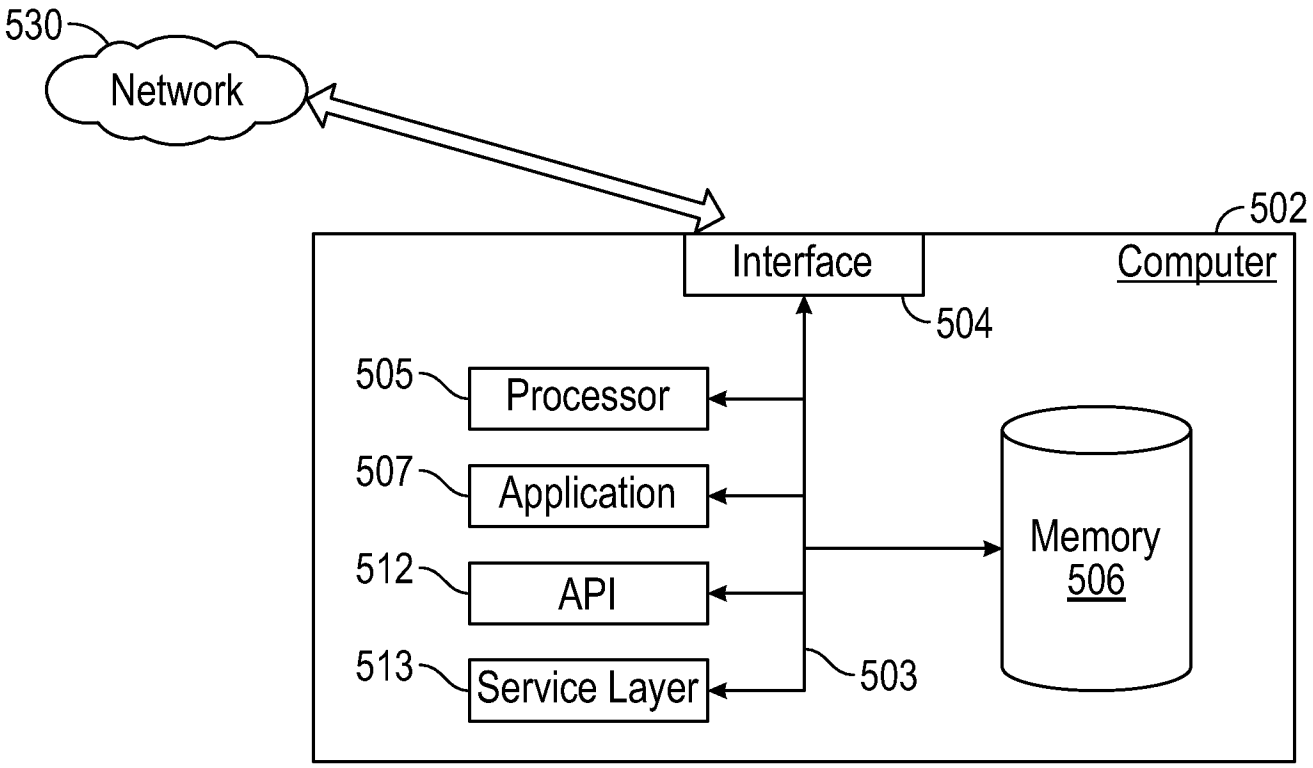
FIG. 5 shows a computer system in accordance with one or more embodiments.

FIG. 5 depicts a block diagram of a computer system (502) used to provide computational functionalities associated with described machine learning networks, algorithms, methods, functions, processes, flows, and procedures as described in this disclosure, according to one or more embodiments. The illustrated computer (502) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (502) may include a computer that includes an input device, such as a keypad, keyboard, touch screen, or other device that can accept user information, and an output device that conveys information associated with the operation of the computer (502), including digital data, visual, or audio information (or a combination of information), or a GUI.

The computer (502) can serve in a role as a client, network component, a server, a database or other persistency, or any other component (or a combination of roles) of a computer system for performing the subject matter described in the instant disclosure. The illustrated computer (502) is communicably coupled with a network (530). In some implementations, one or more components of the computer (502) may be configured to operate within environments, including cloud-computing-based, local, global, or other environment (or a combination of environments).

At a high level, the computer (502) is an electronic computing device operable to receive, transmit, process, store, or manage data and information associated with the described subject matter. According to some implementations, the computer (502) may also include or be communicably coupled with an application server, e-mail server, web server, caching server, streaming data server, business intelligence (BI) server, or other server (or a combination of servers).

The computer (502) can receive requests over network (530) from a client application (for example, executing on another computer (502)) and responding to the received requests by processing the said requests in an appropriate software application. In addition, requests may also be sent to the computer (502) from internal users (for example, from a command console or by other appropriate access method), external or third-parties, other automated applications, as well as any other appropriate entities, individuals, systems, or computers.

Each of the components of the computer (502) can communicate using a system bus (503). In some implementations, any or all of the components of the computer (502), both hardware or software (or a combination of hardware and software), may interface with each other or the interface (504) (or a combination of both) over the system bus (503) using an application programming interface (API) (412) or a service layer (513) (or a combination of the API (512) and service layer (513). The API (512) may include specifications for routines, data structures, and object classes. The API (512) may be either computer-language independent or dependent and refer to a complete interface, a single function, or even a set of APIs. The service layer (513) provides software services to the computer (502) or other components (whether or not illustrated) that are communicably coupled to the computer (502). The functionality of the computer (502) may be accessible for all service consumers using this service layer. Software services, such as those provided by the service layer (513), provide reusable, defined business functionalities through a defined interface. For example, the interface may be software written in JAVA, C++, or other suitable language providing data in extensible markup language (XML) format or another suitable format. While illustrated as an integrated component of the computer (502), alternative implementations may illustrate the API (512) or the service layer (513) as stand-alone components in relation to other components of the computer (502) or other components (whether or not illustrated) that are communicably coupled to the computer (502). Moreover, any or all parts of the API (512) or the service layer (513) may be implemented as child or sub-modules of another software module, enterprise application, or hardware module without departing from the scope of this disclosure.

The computer (502) includes an interface (504). Although illustrated as a single interface (504) in FIG. 5, two or more interfaces (504) may be used according to particular needs, desires, or particular implementations of the computer (502). The interface (504) is used by the computer (502) for communicating with other systems in a distributed environment that are connected to the network (530). Generally, the interface (504) includes logic encoded in software or hardware (or a combination of software and hardware) and operable to communicate with the network (530). More specifically, the interface (504) may include software supporting one or more communication protocols, such as the Wellsite Information Transfer Specification (WITS) protocol, associated with communications such that the network (530) or interface's hardware is operable to communicate physical signals within and outside of the illustrated computer (502).

The computer (502) includes at least one computer processor (505). Although illustrated as a single computer processor (505) in FIG. 5, two or more processors may be used according to particular needs, desires, or particular implementations of the computer (502). Generally, the computer processor (505) executes instructions and manipulates data to perform the operations of the computer (502) and any algorithms, methods, functions, processes, flows, and procedures as described in the instant disclosure.

The computer (502) also includes a memory (506) that holds data for the computer (502) or other components (or a combination of both) that can be connected to the network (530). For example, memory (506) can be a database storing data consistent with this disclosure. Although illustrated as a single memory (506) in FIG. 5, two or more memories may be used according to particular needs, desires, or particular implementations of the computer (502) and the described functionality. While memory (506) is illustrated as an integral component of the computer (502), in alternative implementations, memory (506) can be external to the computer (502).

The application (507) is an algorithmic software engine providing functionality according to particular needs, desires, or particular implementations of the computer (502), particularly with respect to functionality described in this disclosure. For example, application (507) can serve as one or more components, modules, applications, etc. Further, although illustrated as a single application (507), the application (507) may be implemented as multiple applications (507) on the computer (502). In addition, although illustrated as integral to the computer (502), in alternative implementations, the application (507) can be external to the computer (502).

There may be any number of computers (502) associated with, or external to, a computer system containing a computer (502), wherein each computer (502) communicates over network (530). Further, the term "client," "user," and other appropriate terminology may be used interchangeably as appropriate without departing from the scope of this disclosure. Moreover, this disclosure contemplates that many users may use one computer (502), or that one user may use multiple computers (502).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed is:

1. A method, comprising:

defining total depth coordinates of a candidate wellbore path within a hydrocarbon reservoir;

obtaining geoscience data for a subterranean region enclosing the hydrocarbon reservoir;

obtaining historical drilling data from an offset well in the subterranean region;

training a machine learning network to predict drilling hazard probabilities along the candidate wellbore path using the geoscience data and the historical drilling data;

determining a first wellbore path to terminate at the total depth coordinates using the candidate wellbore path and the trained machine learning networks;

drilling a first portion of the first wellbore path;

obtaining first drilling data from drilling the first portion;

re-training the machine learning network using the first drilling data, the geoscience data, and the historical drilling data; and determining a second wellbore path using the re-trained machine learning network.

2. The method of claim 1, further comprising:

drilling a second portion of the second wellbore path;

obtaining second drilling data from drilling the second portion;

re-training the machine learning network using the first drilling data, the second drilling data, the geoscience data, and the historical drilling data; and determining a third wellbore path using the re-trained machine learning network.

3. The method of claim 1, wherein the geoscience data comprises geophysical data.

4. The method of claim 1, wherein the first drilling data and the historical drilling data comprise at least one of: static drilling parameters; dynamic drilling parameters; wellbore path parameters; and non-productive time durations.

5. The method of claim 1, wherein a drilling hazard comprises a collision with the offset well, a shallow gas pocket penetration, or a fault penetration.

6. The method of claim 1, wherein training and re-training the machine learning network comprises executing an imbalanced classification algorithm.

7. The method of claim 6, wherein the imbalanced classification algorithm comprises at least one of: a random undersampling algorithm; a SMOTE oversampling algorithm; a cost-sensitive logistic regression algorithm; a cost-sensitive decision tree algorithm; a cost-sensitive support vector machine algorithm; and a weighted decision tree algorithm.

8. The method of claim 2, further comprising displaying the candidate wellbore path, the first wellbore path, the second wellbore path, or the third wellbore path together with at least one drilling hazard probability in three-dimensional space.

9. A non-transitory computer readable medium storing instructions executable by a computer processor, the instructions comprising functionality for:

receiving total depth coordinates of a candidate wellbore path within a hydrocarbon reservoir;

receiving geoscience data for a subterranean region enclosing the hydrocarbon reservoir;

receiving historical drilling data from an offset well in the subterranean region;

training a machine learning network to predict drilling hazard probabilities along the candidate wellbore path using the geoscience data and the historical drilling data;

determining a first wellbore path to terminate at the total depth coordinates using the candidate wellbore path and the trained machine learning network;

receiving first drilling data from drilling a first portion of the first wellbore path;

re-training the machine learning network using the first drilling data, the geoscience data, and the historical drilling data; and determining a second wellbore path using the re-trained machine learning network.

10. The non-transitory computer readable medium of claim 9, further comprising:

receiving second drilling data from drilling a second portion of the second wellbore path;

re-training the machine learning network using the first drilling data, the second drilling data, the geoscience data, and the historical drilling data; and determining a third wellbore path using the re-trained machine learning network.

11. The non-transitory computer readable medium of claim 9, wherein the geoscience data comprises geophysical data.

12. The non-transitory computer readable medium of claim 9, wherein the first drilling data and the historical drilling data comprise at least one of: static drilling parameters; dynamic drilling parameters; wellbore path parameters; and non-productive time durations.

13. The non-transitory computer readable medium of claim 9, wherein a drilling hazard comprises a collision with the offset well, a shallow gas pocket penetration, or a fault penetration.

14. The non-transitory computer readable medium of claim 9, wherein training the machine learning network comprises executing an imbalanced classification algorithm.

15. The non-transitory computer readable medium of claim 14, wherein the imbalanced classification algorithm comprises at least one of a: a random undersampling algorithm, a SMOTE oversampling algorithm, a cost-sensitive logistic regression algorithm, a cost-sensitive decision tree algorithm, a cost-sensitive support vector machine algorithm, and a weighted decision tree algorithm.

16. The non-transitory computer readable medium of claim 10, further comprising displaying the candidate wellbore path, the first wellbore path, the second wellbore path, or the third wellbore path together with at least one drilling hazard probability in three-dimensional space.

17. A system, comprising:

a computer system configured to:

receive total depth coordinates of a candidate wellbore path within a hydrocarbon reservoir;

receive geoscience data for a subterranean region enclosing the hydrocarbon reservoir;

receive historical drilling data from an offset well in the subterranean region;

train a machine learning network to predict drilling hazard probabilities along the candidate wellbore path using the geoscience data and the historical drilling data;

determine a first wellbore path to terminate at the total depth coordinates using the candidate wellbore path and the trained machine learning network; and a drilling system configured to drill the first wellbore path, wherein the computer system is further configured to:

re-train the machine learning network based, at least in part, on first drilling data obtained using the drilling system to drill a first portion of the first wellbore path, and determine a second wellbore path using the re-trained machine learning network.

* * * * *